United States Patent [19]

Wright

[11] 4,445,123

[45] Apr. 24, 1984

[54] METHOD FOR ESTABLISHING A VERTICAL E-FIELD ANTENNA INSTALLATION

[75] Inventor: Windsor D. Wright, Sherborn, Mass.

[73] Assignee: GTE Products Corporation, Waltham, Mass.

[21] Appl. No.: 354,849

[22] Filed: Mar. 4, 1982

[51] Int. Cl.[3] ..... H01Q 7/00; H01Q 1/04

[52] U.S. Cl. ..... 343/719; 455/129; 343/866; 343/846

[58] Field of Search ..... 343/719, 846–849, 343/866; 455/129, 40, 41; 324/332, 333

[56] References Cited

U.S. PATENT DOCUMENTS

| | | | |
|---|---|---|---|
| 3,183,510 | 5/1965 | Rawls | 343/719 |
| 3,670,247 | 6/1972 | Gutton et al. | 343/719 |
| 3,881,154 | 4/1975 | Lewis et al. | 455/67 |
| 3,967,201 | 6/1976 | Rorden | 455/41 |

OTHER PUBLICATIONS

Fink and Christiansen, Electronics Engineer's Handbook, McGraw-Hill, N.Y., Second Edition, (pp. 18–95).

*Primary Examiner*—Eli Lieberman
*Assistant Examiner*—Michael C. Wimer
*Attorney, Agent, or Firm*—Peter Xiarhos

[57] ABSTRACT

A method of establishing an ELF/VLF, vertical E-field transmitter loop antenna installation. The method comprises the steps of ascertaining a land region having contiguous areas of widely differing (by at least 4 to 1) subsurface conductivity, and positioning a closed loop wire antenna having a high-power, ELF/VLF transmitter in series electrical path therewith in a generally horizontal plane over the interface of the first and second contiguous areas. The closed loop wire antenna may be positioned above the surface of the contiguous areas, or on top or within the contiguous areas. The antenna may take the form of a rectangular, circular or elliptical loop and is positioned with respect to the interface of the contiguous areas as determined by the values of skin depths of the contiguous areas.

18 Claims, 1 Drawing Figure

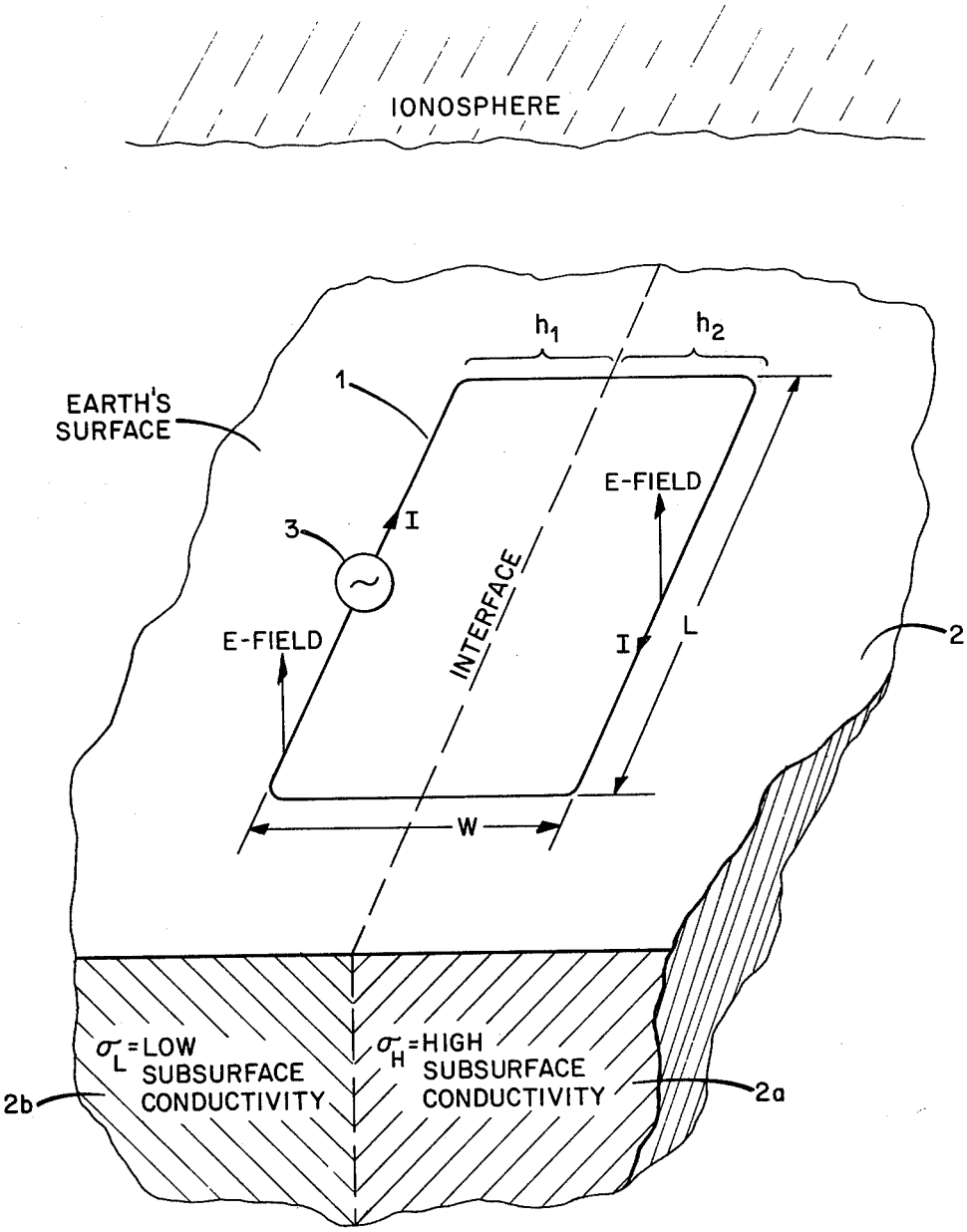
IONOSPHERE
h1
h2
EARTH'S SURFACE
1
E-FIELD
3
I
INTERFACE
E-FIELD
I
L
2
W
σL = LOW SUBSURFACE CONDUCTIVITY
σH = HIGH SUBSURFACE CONDUCTIVITY
2b
2a

METHOD FOR ESTABLISHING A VERTICAL E-FIELD ANTENNA INSTALLATION

FIELD OF THE INVENTION

The present invention relates to a method for establishing an antenna installation and, more particularly, to a method for establishing an ELF/VLF, vertical E-field, transmitting loop antenna installation.

BACKGROUND OF THE INVENTION

In ELF (extremely low frequency) and VLF (very low frequency) communications systems, it is normal practice to employ a transmitting antenna for launching a vertical electrical field (E-field) into the cavity or space between the earth's surface and the ionosphere to be thereupon detected by receivers within this space. Generally speaking, in the VLF band, such an antenna may take the form of a vertical loop or vertical mast or , alternatively, in the ELF/VLF band, a horizontal wire located within or close to the earth's surface. Vertical transmitting loops or masts, while suitable for short-range applications of less than 50 miles, are impractical because of their low radiation efficiency for long distance communications, for example, over a range of several thousand miles. In this latter instance, the vertical loop or mast (at ELF) must be impractically tall, for example, several thousand feet high, to achieve efficient long-range operation.

The use of horizontal wire antennas for E-field transmission also has disadvantages and drawbacks. This type of antenna, whether located above ground (and uninsulated) or below ground (and insulated), requires a low-conductivity subsurface for efficient operation, as well as requiring sizable grounding networks at its two ends. These grounding networks, which generally include a few miles of bare wire buried into the earth several feet below the earth's surface (e.g., 5–6 feet), are expensive and difficult to install and to balance electrically. The grounding networks can also create potential safely hazards when used at high current levels, for example, 300 amperes. Further, because of ohmic resistance to current flow through the ground (between the ends of the wire antenna), the efficiency of the antenna is degraded and results in appreciable power losses. If the wire is formed into a loop with a horizontal orientation, the resulting electric field is principally horizontally-oriented and the effective transmitting range of the loop is less than 50 miles and therefore unsuitable for long-range operation.

BRIEF SUMMARY OF THE INVENTION

In accordance with the present invention, a method for establishing a vertical E-field transmitting antenna installation is provided which avoids the problems and disadvantages of prior art installations as briefly described hereinabove.

The method in accordance with the present invention comprises the steps of ascertaining a land region having first and second contiguous areas of widely differing values of subsurface conductivity, and positioning a closed loop wire antenna having a transmitter associated therewith in a generally horizontal plane over the interface of the first and second contiguous areas. By the appropriate selection of land sites, loop antenna configurations, dimensions and positioning, and by the appropriate selection of transmitting frequency for the loop antenna, effective, practical ELF/VLF communications can be established over a range of several thousand miles while avoiding the shortcomings associated with prior art antenna installations as previously described.

BRIEF DESCRIPTION OF THE DRAWING

In the drawing:

The single FIGURE of the drawing illustrates schematically an ELF/VLF, long-range, vertical E-field transmitting antenna installation as established in accordance with the method of the present invention.

DETAILED DESCRIPTION OF THE INVENTION

Referring now to the single FIGURE of the drawing, there is shown an ELF/VLF, long-range, vertical E-field transmitting antenna 1 as installed relative to the surface of a ground region 2 in accordance with the method of the present invention. The antenna 1 as shown in the drawing takes the form of a closed loop, for example, of rectangular configuration, and includes a transmitter 3 arranged in serial path therewith. The antenna loop 1 may be implemented by a standard copper or aluminum multi-strand (e.g., one-inch diameter) wire or cable and, for the rectangular configuration shown in the drawing, has a typical length L of 10 miles and a typical width W of 2 miles (for a total of 24 miles of wire). The antenna loop 1 may be placed in a horizontal plane on or under the surface of the ground region 2, in which case it should be insulated, or above the surface of the ground region 2, in which case it may be bare (that is, uninsulated). In the latter situation and although not shown in the drawing, the loop 1 should be elevated and supported, for example, by means of poles located about every 300 feet along the perimeter of the loop 1, so as to allow sufficient room for passage thereunder of people and standard vehicles such as cars and trucks. If the loop 1 is used at ground level, it may have several turns instead of a single turn as shown in the drawing.

The aforementioned transmitter 3 employed within the loop 1 may be a standard high-power, ELF/VLF transmitter having a typical power output of about 200 kilowatts, an operating frequency of 30–100 hertz, and capable of causing a current flow of about 300 amperes through the loop 1. Whether the loop 1 is on, below, or above the surface of the ground region 2, the principal flow of current is through the loop and not through the ground as in the case of prior art loops as previously described. There is, thus, no need for grounding networks, and the various problems associated with such grounding networks, such as installation, electrical balancing, safety hazards, ground losses, and current limitations, are avoided.

A critical and important aspect of the present invention is the ascertaining and selecting of the ground region 2 to have specific subsurface conductivity characteristics. More particularly, the ground region 2 is selected, employing established geological and electrical measurement techniques, to have contiguous land areas 2*a* and 2*b* of high and low subsurface conductivities, designated $\sigma_H$ and $\sigma_L$, respectively, so that when the loop 1 is placed over or straddles the interface of these two contiguous areas, as shown for example in the drawing, a vertical electric field (E-field) component is radiated by the loop. The E-field fills the space or cavity between the surface of the ground and the ionosphere in such a manner that the space effectively acts as a waveguide between the ground surface and the ionosphere for propagating the E-field for long distances (up to several thousand miles) with low atmospheric attenuation. The E-field may be electrically modulated as desired by control of the transmitter 3 and be detected by suitable receivers (not shown) located within the space or cavity between the surface of the ground and the ionosphere. It is not absolutely necessary that the interface between the two land areas 2*a* and 2*b* of substantially different subsurface conductivities be at the exact center of the loop as shown in the drawing, the actual positioning being determined by the so-called electrical "skin depth" (a standard measure of the depth of current flow into the ground) of each of the two areas 2*a* and 2*b*. The interface also need not be especially linear to achieve proper operation ot the loop. For effective operation, the loop 1 may also have a physical configuration other than rectangular, for example, an elliptical or circular configuration. The ratio of subsurface conductivities $\sigma_H/\sigma_L$ for the areas 2*a* and 2*b* which has been determined to be particularly suitable for practicing the present invention is a ratio of 10:1 or greater, although the satisfactory operation is also possible for a ratio as low as 4:1.

The performance of the antenna loop 1 as described hereinabove can more clearly be understood by picturing or considering the loop 1 as having two halves, h1 and and h2, and analyzing individually the performance of the two halves. For this analysis, the half h1 is considered as lying over the low subsurface conductivity area 2*b* and the half h2 is considered as lying over the high subsurface conductivity area 2*a*.

The vertical E-field radiation of the half h1 of the loop 1 can be equated to that of a vertically-oriented rectangular loop of a length $L_1$ and an effective vertical height $H_1$ where $$H_1 = \frac{1}{\sqrt{2}} \times \delta_1.$$

In the above expression, $\delta_1$ is the aforementioned skin depth (in meters) for the half h1 of the horizontal rectangular loop, and has a value of $$\delta_1 = \frac{1}{\sqrt{\pi f \mu_0 \sigma_L}},$$

where f is the loop operating frequency (in hertz), $\mu_0 = 4\pi \times 10^{-7}$ henry/meter, and $\sigma_L$ is the conductivity (mho/m) of the area 2*b*. Thus, $$H_1 = \frac{1}{\sqrt{2}} \times \frac{1}{\sqrt{\pi f \mu_0 \sigma_L}}.$$

In similar fashion, the vertical E-field radiation of the second half h2 of the horizontal loop 1 can be equated to that of a vertical rectangular loop of a length $L_1$ and an effective vertical height $H_2$ where $$H_2 = \frac{1}{\sqrt{2}} \times \delta_2 = \frac{1}{\sqrt{2}} \times \frac{1}{\sqrt{\pi f \mu_0 \sigma_H}}.$$

A current, I, flows in each half of the horizontal loop. Its consequent effect in the equivalent vertical loops is of equal magnitude but opposite directional sense. The resultant radiational effects of the respective halves as determined by the products of current and loop area may thus be expressed as follows:

$$\text{Loop 1: } I \times L \times \delta_1/\sqrt{2} = I \times L_1 \times \frac{1}{\sqrt{2\pi f \mu_0 \sigma_L}} \text{ and}$$

$$\text{Loop 2: } (-)I \times L \times \delta_2/\sqrt{2} = (-)I \times L_1 \times \frac{1}{\sqrt{2\pi f \mu_0 \sigma_H}}.$$

The combined vertical radiational effect is expressed as follows:

$$I \times L_1 \times [\delta_1 - \delta_2] = I \times L_1 \times \frac{1}{\sqrt{2\pi f \mu_0}} \left[ \frac{1}{\sqrt{\sigma_L}} - \frac{1}{\sqrt{\sigma_H}} \right].$$

The foregoing expression demonstrates that the efficiency with which a vertical E-field can be launched is proportional to the difference between the reciprocal of the square root of earth conductivity under the respective halves of the horizontal loop. The expression further demonstrates that the loop will perform as intended only if the above-described differences in earth conductivity are present. That is, if the loop is placed over a region of homogeneous earth (and, thus, homogeneous subsurface conductivity), in which case $\sigma_L = \sigma_H$, a zero vertical E-field radiation results.

While there has been described what is considered to be a preferred embodiment of the invention, it will be apparent to those skilled in the art that various changes and modifications may be made therein without departing from the invention as called for in the appended claims.

What is claimed is:

1. A method for establishing a vertical E-field transmitting antenna installation comprising the steps of:

ascertaining a land region having first and second contiguous areas of widely differing values of subsurface conductivity; and positioning a closed loop wire antenna having a transmitter associated therewith in a generally horizontal plane over the interface of the first and second contiguous areas.

2. A method in accordance with claim 1 wherein:

the closed loop wire antenna is positioned relative to the interface of the first and second contiguous areas as determined by the values of skin depths of the first and second contiguous areas.

3. A method in accordance with claim 2 wherein:

the closed loop wire antenna has a generally rectangular configuration.

4. A method in accordance with claim 2 wherein:

the closed loop wire antenna has a generally circular configuration.

5. A method in accordance with claim 2 wherein:

the closed loop wire antenna has a generally elliptical configuration.

6. A method in accordance with claim 1 wherein: the closed loop wire antenna is positioned above the surface of the first and second contiguous areas.

7. A method in accordance with claim 6 wherein:

the closed loop wire antenna is positioned relative to the interface of the first and second contiguous areas as determined by the values of the skin depths of the first and second contiguous areas.

8. A method in accordance with claim 6 wherein: the closed loop wire antenna is an uninsulated metal wire.

9. A method in accordance with claim 1 wherein: the closed loop wire antenna is an insulated metal wire and is positioned in direct physical contact with the first and second contiguous areas.

10. A method in accordance with claim 1 wherein: the subsurface conductivity of one of the two contiguous areas is at least four times the subsurface conductivity of the other area.

11. A method in accordance with claim 10 wherein: the subsurface conductivity of one of the two contiguous areas is at least ten times the subsurface conductivity of the other area.

12. A method in accordance with claim 10 wherein: the closed loop wire antenna is positioned above the surface of the first and second contiguous areas.

13. A method in accordance with claim 12 wherein: the closed loop wire antenna is positioned relative to the interface of the first and second contiguous areas as determined by the values of the skin depths of the first and second contiguous areas.

14. A method in accordance with claim 13 wherein: the transmitter is a high-power, ELF/VLF transmitter.

15. A method in accordance with claim 14 wherein: the closed loop wire antenna has a generally rectangular configuration.

16. A method in accordance with claim 10 wherein: the closed loop wire antenna is an insulated metal wire and is positioned in direct physical contact with the first and second contiguous areas.

17. A method in accordance with claim 16 wherein: the closed loop wire antenna is positioned relative to the interface of the first and second contiguous areas as determined by the values of the skin depths of the first and second contiguous areas.

18. A method in accordance with claim 17 wherein: the transmitter is a high-power, ELF/VLF transmitter.

* * * * *